US007533443B2

(12) United States Patent
Benner

(10) Patent No.: US 7,533,443 B2
(45) Date of Patent: May 19, 2009

(54) DEVICE FOR BLOCKING OPEN THE DOOR OF A HOUSING

(75) Inventor: Rolf Benner, Herborn-Amdorf (DE)

(73) Assignee: Rittal GmbH & Co. KG, Herborn (DE)

( * ) Notice: Subject to any disclaimer, the term of this patent is extended or adjusted under 35 U.S.C. 154(b) by 171 days.

(21) Appl. No.: 11/584,240

(22) Filed: Oct. 20, 2006

(65) Prior Publication Data

US 2007/0101650 A1 May 10, 2007

(30) Foreign Application Priority Data

Oct. 20, 2005 (DE) ..... 10 2005 050 639

(51) Int. Cl.
*E05F 5/02* (2006.01)

(52) U.S. Cl. ..... 16/82

(58) Field of Classification Search ..... 16/82, 16/85, 86 A, 86 R, 374, 375
See application file for complete search history.

(56) References Cited

U.S. PATENT DOCUMENTS

| | | | | | |
|---|---|---|---|---|---|
| 176,404 | A * | 4/1876 | Lovelace | 16/85 |
| 367,742 | A * | 8/1887 | Byrne | 16/375 |
| 1,071,134 | A * | 8/1913 | Bedard | 16/85 |
| 1,073,253 | A * | 9/1913 | Lavelle | 16/86 A |
| 1,212,663 | A * | 1/1917 | Carter | 16/86 A |
| 1,329,313 | A * | 1/1920 | Seabury et al. | 16/85 |
| 1,514,845 | A * | 11/1924 | Fischer | 292/75 |
| 1,605,296 | A * | 11/1926 | Silvers | 16/375 |
| 1,616,265 | A * | 2/1927 | Kroehling | 16/375 |
| 1,700,086 | A * | 1/1929 | Sherwood | 16/85 |
| 1,730,646 | A * | 10/1929 | Danner | 16/85 |
| 1,757,075 | A * | 5/1930 | Earhart | 16/371 |
| 1,865,404 | A * | 6/1932 | Winans | 16/86 R |
| 2,487,745 | A * | 11/1949 | Witmer | 292/166 |
| 2,883,254 | A * | 4/1959 | Bacca | 312/242 |
| 2,964,780 | A * | 12/1960 | Blankenship | 16/82 |
| 3,172,168 | A * | 3/1965 | Suska | 49/400 |
| 3,531,824 | A * | 10/1970 | Hagendoorn et al. | 16/222 |
| 3,862,774 | A * | 1/1975 | Johnson | 292/228 |
| 4,110,867 | A * | 9/1978 | Gwozdz | 16/82 |
| 4,462,623 | A * | 7/1984 | Grant | 292/175 |
| 6,425,610 | B1 * | 7/2002 | Reuter et al. | 292/202 |
| 6,467,125 | B1 * | 10/2002 | Johnson | 16/82 |
| 6,510,587 | B2 * | 1/2003 | Urschel et al. | 16/83 |
| 6,588,811 | B1 * | 7/2003 | Ferguson | 292/251.5 |

(Continued)

FOREIGN PATENT DOCUMENTS

DE 407751 1/1925

(Continued)

*Primary Examiner*—Victor Batson
*Assistant Examiner*—Roberta Delisle
(74) *Attorney, Agent, or Firm*—Pauley Petersen & Erickson

(57) ABSTRACT

A device for blocking open a door of a housing, having a housing body on which the door is hinged. A clamping element can be inserted into an area between the housing body and the door. The clamping element is arranged on an inside of the door rotatable around an axis of rotation, which extends perpendicularly with respect to the door and is eccentrically seated on the clamping element. The clamping element can be rotated into a clamping position in which the clamping element projects past or beyond the door when the door is opened and can be brought into contact with the housing body.

33 Claims, 8 Drawing Sheets

U.S. PATENT DOCUMENTS 6,658,695 B1 * 12/2003 Genua ..... 16/66
6,732,410 B1 * 5/2004 Nedderman, Jr. ..... 16/374
6,772,983 B1 * 8/2004 Liao et al. ..... 248/291.1
7,076,834 B2 * 7/2006 Li ..... 16/85
2007/0226954 A1 * 10/2007 Artsiely ..... 16/63

FOREIGN PATENT DOCUMENTS

DE 198 32 578 1/2000

* cited by examiner

DEVICE FOR BLOCKING OPEN THE DOOR OF A HOUSING

BACKGROUND OF THE INVENTION

1. Field of the Invention

This invention relates to a device for blocking open a door of a housing, in particular a switchgear cabinet, having a housing body on which the door is hinged, wherein a clamping element can be inserted into the area between the housing body and the door.

2. Discussion of Related Art

Devices for blocking a door open are generally known. For example, for maintaining the door of a switchgear cabinet in the open state, or for preventing the door from being inadvertently closed, for example by a draft, a wedge or other suitable object is often used. The wedge is then pushed into the gap between the door and the body of the switchgear cabinet defined by the hinge. In this way, the object is wedged between the door and the body of the switchgear cabinet and effectively prevents the door from being closed. It is also possible to place a heavy object against the open door to prevent it from being shut.

However, this solution has one disadvantage that, for keeping the door open, an additional object is required, which can become lost. Also, these objects are very cumbersome to manipulate, and their use sometimes entails the danger of injury.

A device for keeping a door open, which is fixedly attached between the door and body of the switchgear cabinet, is known. This device substantially includes a long metal element, which is hinged to the upper portion of the door by a rotary seating. A guide device for the metal element is on the cabinet body. The metal element has an elongated hole, in which a guide pin is conducted. When opening the door, the metal element is pulled out in the direction of the opening door and the pin guided in the elongated hole guides the movement of the metal element. As soon as the door is brought into its open position, the pin catches in a recess in the elongated hole, so that the door is maintained in the open position. Thus, the extended metal element forms a support of the door on the cabinet body.

However, this known device for keeping the door open has a relatively complicated construction and is not easy to manipulate, in particular when closing the door. Also, the known device must be quite large, in particular in connection with heavy cabinet doors, in order to attain the required stability. This leads to an increased space requirement at the upper inside of the door, or in the adjoining area of the cabinet body. When installing this device it is necessary to drill a plurality of holes for installation, which is expensive, particularly with metal doors, and increases the manufacturing costs.

SUMMARY OF THE INVENTION

It is one object of this invention to provide a device for blocking open a door of a housing which is particularly simply constructed and easy to manipulate. The blocking device in accordance with this invention may require little space.

This object of the invention is attained by a device having characteristics described in this specification and in the claims.

Accordingly, the clamping element is arranged on the inside of the door so that it can be rotated around an axis of rotation which extends perpendicularly with respect to the door, and is eccentrically seated in the clamping element. In this case, the clamping element can be rotated into a clamping position in which the clamping element projects beyond the door when opened and can be brought into contact with the housing body. With an appropriate shaping of the clamping element and by the eccentrically arranged axis of rotation it is possible for a portion of the clamping element to project beyond the door, at least in the opened position of the door. With a simple rotatory movement this protruding portion of the clamping element can then be introduced into the area between the door and the housing body defined by the hinge, so that a closing of the door is effectively prevented. Thus the clamping element can be clamped between the door and the housing body to keep the door open.

The clamping element can also be rotated into a neutral position. In this neutral position, the clamping element does not project past or beyond the door and can be received inside the housing body when the door is closed. Depending on the size of the clamping element, the space requirement is relatively small, in particular because no protruding installation elements are required.

In accordance with one embodiment, the blocking position is shifted by 180° with respect to the neutral position. However, the two positions can also be shifted with respect to each other, under different angles. In this case, it is only necessary to assure that the desired clamping effect between the door and the housing body is provided in the blocking position and that the door can be closed in the neutral position.

In another embodiment, the clamping element can have a holding device, which maintains the clamping element in the blocking position, for one, and otherwise in the neutral position. The holding device assures that the two positions can be definitely assumed and are fixed.

One embodiment has a guide strip arranged on the door, which engages a recess cut into the clamping element. Such a holding device is very simply constructed and also has a sufficient functional dependability.

In an advantageous manner, the axis of rotation can be defined by a pin, one end of which is fixed in place on the guide strip. In this case, the pin extends through a first through-bore in the clamping element, which is arranged perpendicularly with respect to the recess and eccentrically with respect to the axis of symmetry of the clamping element. Thus it is possible to simply provide the rotatory seating for the clamping element.

In accordance with one embodiment, the pin can have a head at the free end located opposite the end fixed on the guide strip, wherein a compression spring is acting between the head and the clamping element and clamps the guide strip in place in the recess. In another embodiment, the compression spring can be constituted as a helical spring into which the pin is introduced.

So that the compression spring can be dependably supported on the clamping element, a shoulder on which the helical spring is supported can be formed in the through-bore on the side of the clamping element facing the compression spring.

In one simple construction, the pin is embodied as a screw, which engages a threaded element arranged in the guide strip. The screw has a head required for supporting the helical spring and can be fastened in a simple manner on the guide strip.

In one embodiment, such as for use in a switchgear cabinet, the guide strip can be formed by a perforated door strip. The perforated door strips are used for mounting additional components in connection with switchgear cabinet doors.

So that the clamping element can be used for doors which are hinged on the right or the left, as well as in the upper or lower area of a door, a second through-bore which is arranged eccentric with respect to the axis of symmetry of the clamping element, is cut in the clamping element and extends parallel with the first through-bore and perpendicular to the recess. The manufacturing expenses for differently oriented clamping elements are reduced by the second through-bore.

In one embodiment, a blocking element, which maintains the door in the open position, can act between the clamping element and the housing body. In this case the blocking element can be embodied, for example, as a depression or protrusion, or as an appropriate fixation, on a section facing the housing body and which, in the support position for the door, automatically fixes the respective area of the housing body, so that in the pivoted position the door is also secure against an automatic free outward pivot movement. In this case, a snap-in holder can be provided between the clamping element and the housing body, which causes an automatic fixation and securing of the door.

In another embodiment, the clamping element can have a contact area by which the clamping element contacts the housing body when the door is open. Thus, a particularly dependable fixing of the door in the open position is simply achieved if the contact area of the clamping element has a groove-like recess, into which a support element provided on the housing body extends when the door is open, and is supported against the clamping element. Here, the support element can form the frame element of the housing body to which at least one door hinge is attached.

The clamping element can be modified so that it can be used in connection with various types of hinges. It is also possible to provide different clamping elements for different hinges. For this reason, the contact area of the clamping element, or the blocking element, can be matched to the respectively used door hinge.

In accordance with another embodiment, the contact area of the clamping element can have a step-shaped extension, against which a support element protruding from the housing body is supported when the door is open. With this, even a heavy door is dependably and stably maintained in the open position.

BRIEF DESCRIPTION OF THE DRAWINGS

This invention is explained in view of preferred embodiments while making reference to the attached drawings, wherein.

DETAILED DESCRIPTION OF THE INVENTION

Figure 1:
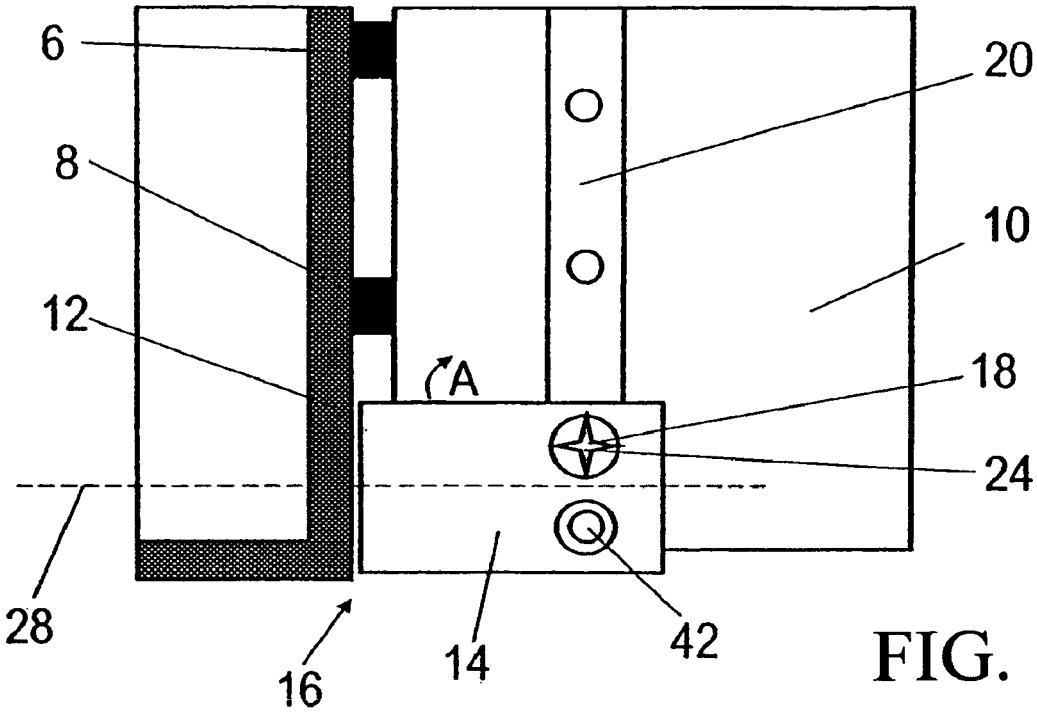
FIG. 1 shows in a schematic partial view one embodiment of a device for blocking open a door of a switchgear cabinet, wherein the clamping element is shown in a blocking position.
Figure 2:
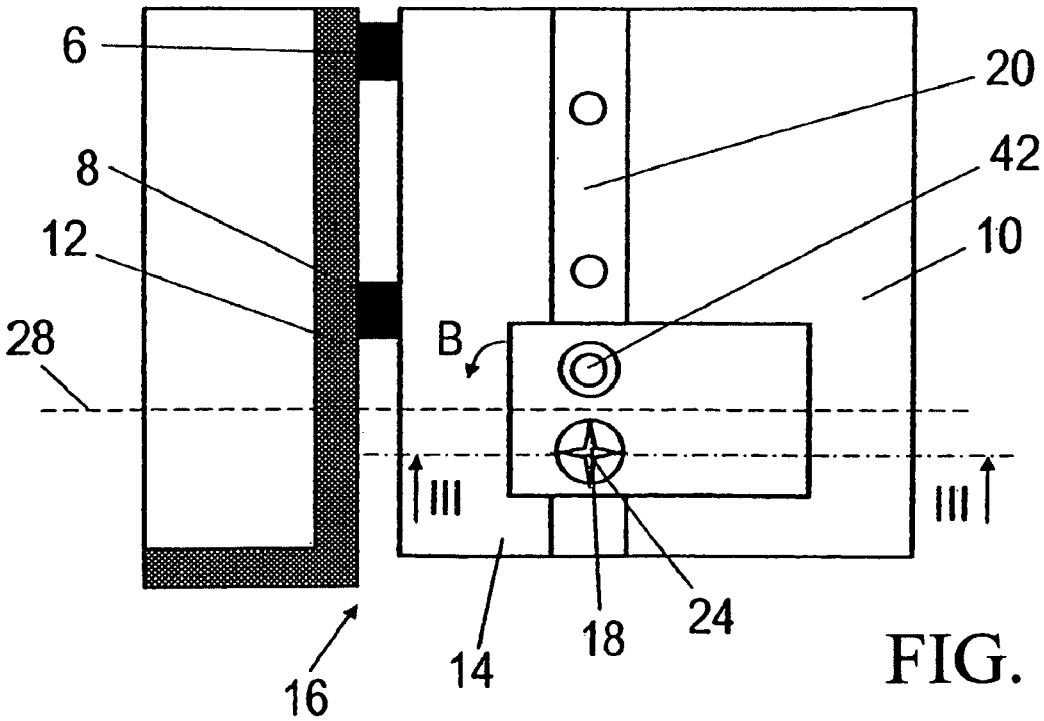
FIG. 2 shows the device in accordance with FIG. 1, in a schematic partial view, wherein the clamping element is shown in a neutral position.

FIGS. 1 and 2 show in a schematic plan view one embodiment of the device for blocking open a door 10 of a switchgear cabinet. The switchgear cabinet has a cabinet body 12, which is only partially represented. A door 10, also only partially shown, is hinged to the cabinet body 12 by hinges 6 and 8 and is shown in the open position. A clamping element 14 is arranged at the lower edge toward the switchgear cabinet of the door 10, in the area l6 between the housing body 12 and the door 10.

In FIG. 1, the clamping element 14 is shown in the blocking position. In this case, with the door 10 open, the clamping element 14 projects past or beyond the door 10 and extends into the area 18 between the cabinet body 12 and the door 10. The clamping element comes to rest against the housing body 12. Thus, in its blocking position, the clamping element 14 prevents the closing of the door.

The clamping element 14 is attached to the inside of the door 10 and can be rotated around an axis of rotation 18, which extends perpendicular to the door 10 and is eccentrically arranged with respect to the plane of symmetry 28 of the clamping element 14, in a direction of the arrow A in a clockwise direction. If the clamping element 14 is further rotated in the direction of the arrow A, it reaches the neutral position represented in FIG. 2, which allows closing of the door 10. In this way, the clamping element 14 does not project past or beyond the door 10 and, with the door 10 closed, can be received inside the housing body 12. If the clamping element 14 is rotated back in the direction of the arrow B in a counterclockwise direction, it returns back into the blocking position shown in FIG. 1. The blocking position is pivoted by 180° with respect to the neutral position.

Figure 3:
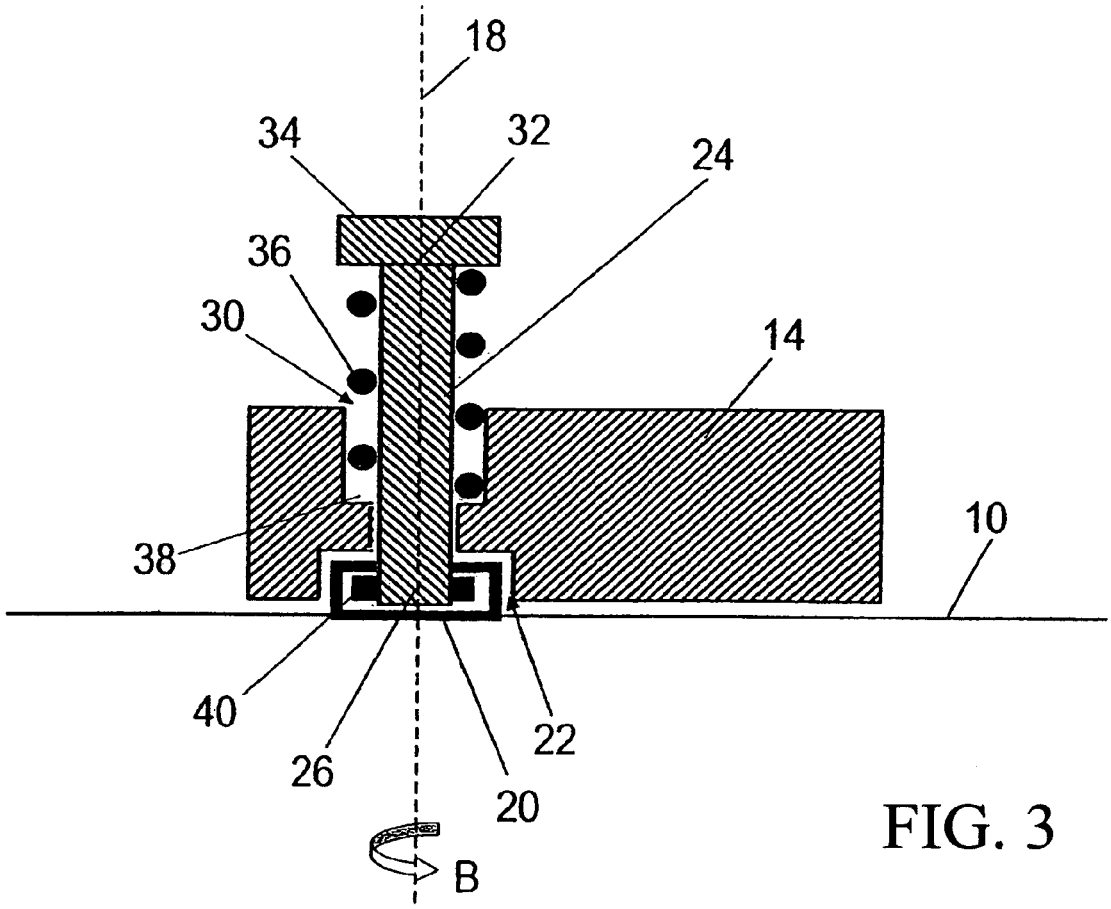
FIG. 3 shows the device for blocking open a door of a switchgear cabinet, in a schematic plan view and in a sectional view in accordance with the section line III-III shown in FIG. 2.

FIG. 3 shows a schematic sectional representation of the blocking device in accordance with the section line III-III in FIG. 2. The clamping element 14 is connected with a holding device, which for one holds the clamping element 14 in the blocking position, and otherwise in the neutral position. The holding device has a guide strip 20 applied to the door 10, which engages a recess 22 cut into the underside of the clamping element 14 facing the door 10. In the embodiment represented, the guide strip 20 is formed by a perforated door strip, such as is customary when equipping a switchgear cabinet door. The perforated door strip is embodied as an elongated U-shaped or C-shaped hollow profiled element, which has through-holes 21 arranged at identical distances from each other, and is attached to the inside of the door 10. A threaded element 40 is applied to the inside of the hollow profiled element, to which the end 26 of a screw 24 is screwed through the hole 21 and which thus is fixed in place on the perforated door strip.

A first through-bore 30 is provided in the clamping element 14 perpendicularly with respect to the recess 22 and is arranged eccentrically with respect to the axis of symmetry 28, represented in FIGS. 1 and 2, of the clamping element 14. The screw 24 extends through the through-bore 30. Together with the screw 24, the through-bore 30 forms the rotatory seating for the clamping element 14 and defines the axis of rotation 18.

The screw 24 has a head 34 at its free end 32, which is located opposite the end 26 fixed in place on the guide strip 20 or on the perforated door strip. A helical spring 36, which clamps the guide strip 20 in place in the recess 22, is supported between the head 34 and a shoulder 38 in the through-bore 30. The screw 24 is inserted into the helical spring 36.

The clamping element 14 can be manually lifted in the direction of the arrow R against the spring force of the helical spring 36. Thus, the recess 22 comes out of contact with the guide strip 20 or the perforated door strip. As a result the clamping element 14, in a state not shown, in which it is lifted-off in the direction of the arrow R, can be rotated around the axis of rotation 18 in the direction of the arrow B. In this way, the clamping element 14 can be brought out of the neutral position represented in FIGS. 3 and 2 into the blocking position represented in FIG. 1, and vice versa.

As shown in FIGS. 1 and 2, a second through-bore 42, which is arranged eccentrically with respect to the axis of symmetry 28 of the clamping element 14, is cut into the clamping element 14 and extends parallel with the first through-bore 30 and perpendicular to the recess 22. The second through-bore 42 performs the same function as the first through-bore 30. The two through-bores 30 and 42 are provided so that the clamping element 14 can be identically employed in connection with doors which are hinged on the right or the left, as well as on the upper and the lower areas of a door.

Figure 4:
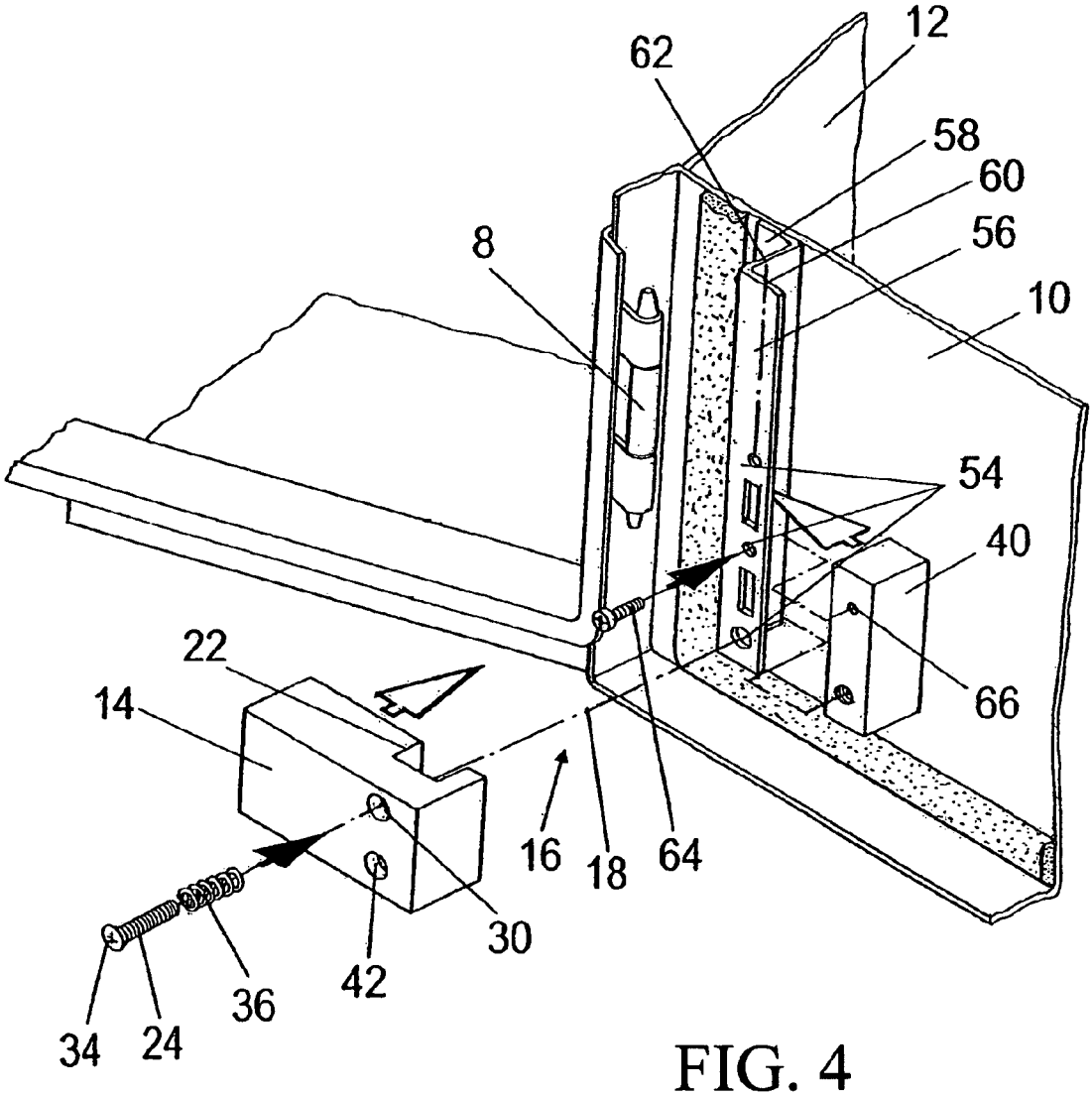
FIG. 4 shows a blocking device similar to the embodiments shown in FIGS. 1 to 3, in a schematic perspective partial view and an exploded representation, wherein a state is shown in which the clamping element is inserted in the blocking position.

FIG. 4 shows in a schematic perspective partial view and in an exploded representation a similar embodiment of the blocking device, wherein a state is shown in which the clamping element 14 is inserted in the blocking position. The clamping element 14 can be attached to the guide strip 56 so that it enters into the recess 22. In the embodiment shown, the guide strip 56 is in a form of an elongated, approximately Z-shaped hollow profiled element. The Z-shaped hollow profiled element comprises two longitudinal profiled elements 58 and 60 extending parallel with respect to each other, which are connected and supported by a longitudinal strip 62 extending perpendicularly in relation to them. The longitudinal profiled element 58 is attached directly to the inside of the door. The longitudinal profiled element 60 extending parallel with it is spaced apart from the inside of the door by the longitudinal strip 62 and has through-holes 54. A threaded element 40 can be provided in the side of the longitudinal profiled element 58 facing the inside of the door, which can be fastened on the guide strip 56. Thus, a screw 64 is inserted through one of the through-holes 54 and is screwed into a corresponding threaded bore 66 in the threaded element 40.

Two through-bores 30 and 42 are provided in the clamping element 14, which are applied perpendicularly with respect to the recess 22. In the orientation of the clamping element shown in FIG. 4, the screw 24 is inserted into the through-bore 30. The screw 24 has the head 34 on one end. A helical spring 36, which clamps the guide strip 56 in the recess 22, is supported between the head 34 and a shoulder, not represented in FIG. 4, inside the through-bore 30. In this case, the screw 24 is inserted into the helical spring 36.

Figure 5:
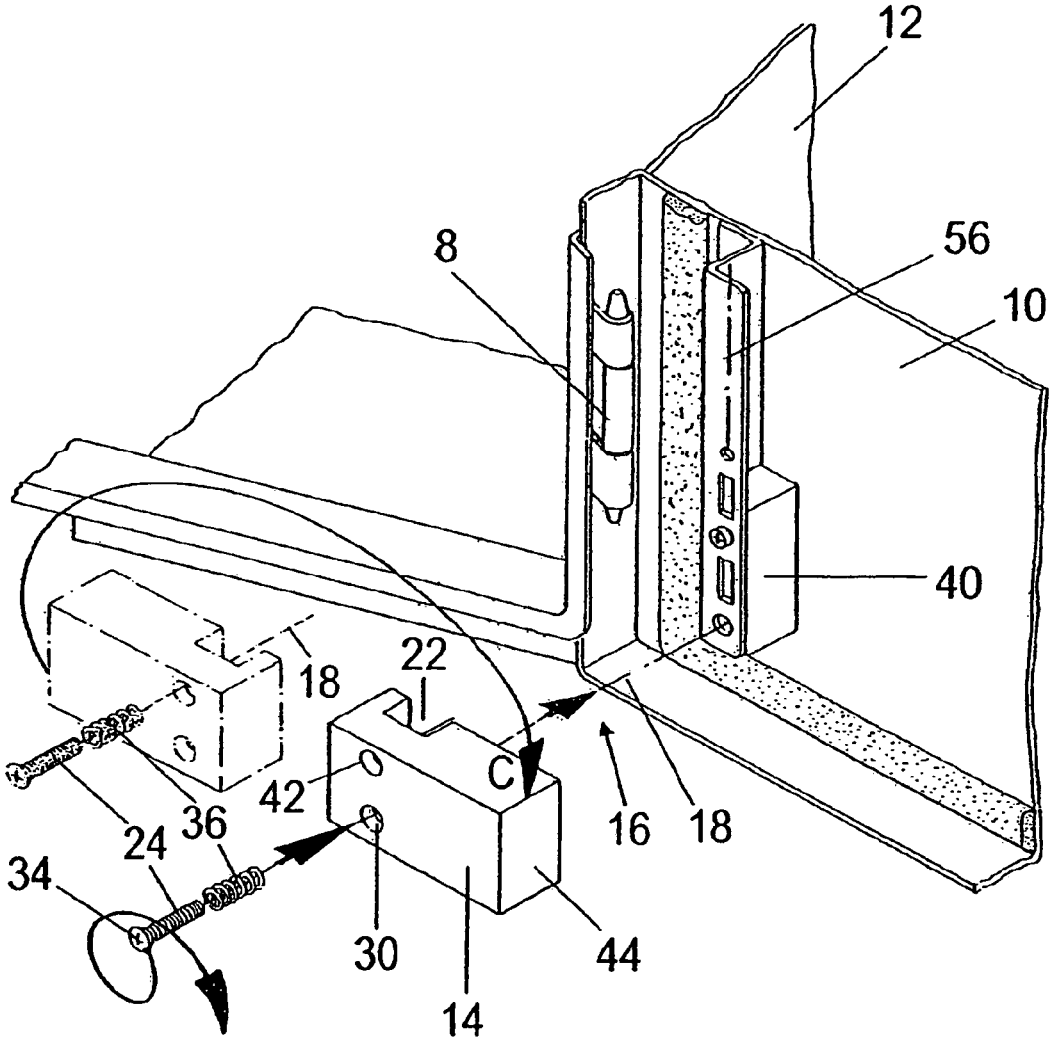
FIG. 5 shows the embodiment of the blocking device shown in FIG. 4, in a schematic perspective partial view and exploded representation, wherein a state is shown in which a clamping element is inserted in the neutral position and can be brought into the blocking position by pivoting.

FIG. 5 shows the embodiment of the blocking device of FIG. 4, in a schematic perspective partial view and in an exploded representation, wherein the clamping element 14 is inserted in the neutral position. This state is shown by solid lines in FIG. 5 and has been explained in connection with FIG. 4.

It is also shown in FIG. 5, by dash-dotted, or thin lines to the left of the neutral position, that the clamping element 14 can be pivoted into the blocking position around the pivot axis 18 defined by the screw 24, similar to the manner as described in view of FIGS. 1 and 2. The arrow C indicates a pivot direction from the blocking position to the neutral position.

On one side the clamping element 14 has a contact area 44, against which the clamping element 14 can be brought to rest against the housing body 12 when the door 10 is open. The contact area 44 is designed flat and is used for supporting the door 10 on the housing body 12.

Figure 6:
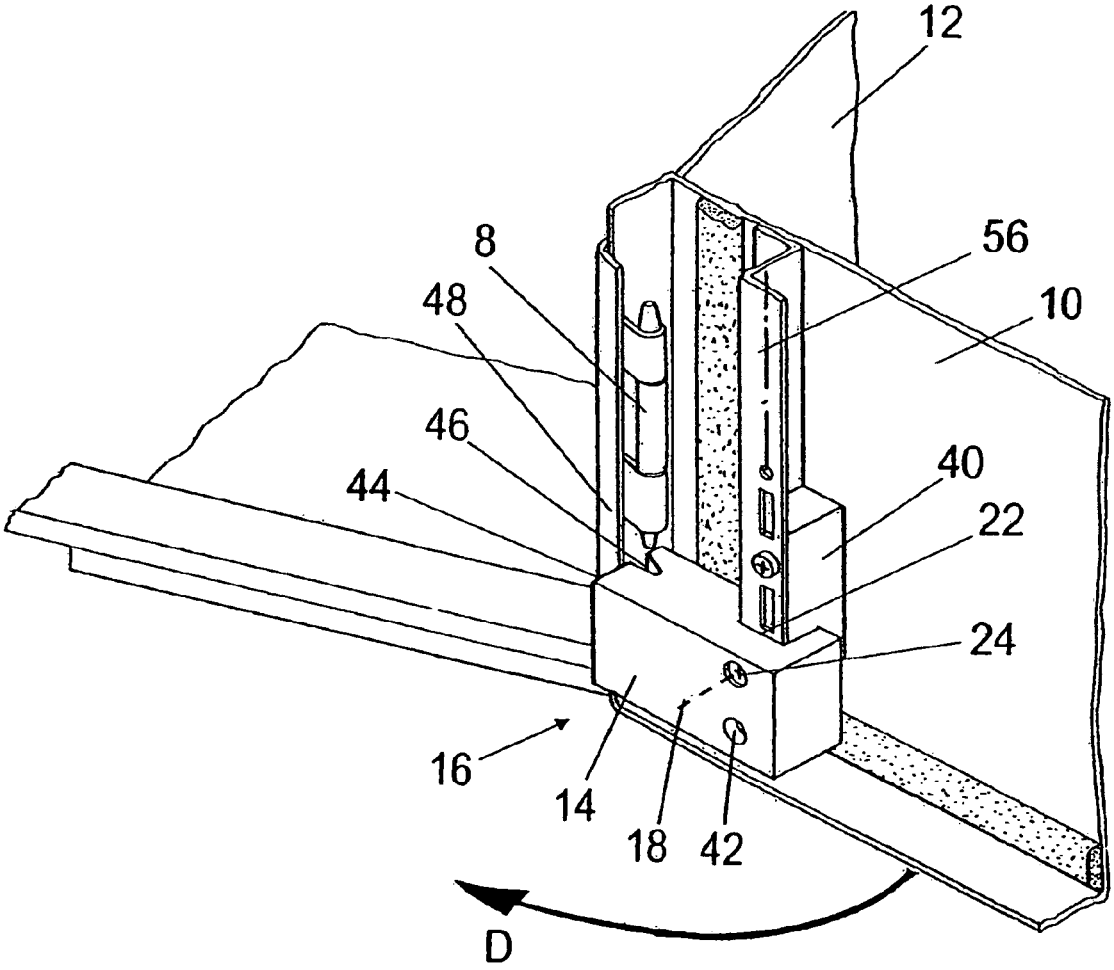
FIG. 6 shows a further embodiment of the blocking device in a schematic perspective partial view, wherein a state is represented, in which a clamping element is inserted in the blocking position and a support element protruding from the housing body can enter into a groove-like recess in the clamping element.

In a schematic perspective partial view, FIG. 6 shows a further embodiment of the blocking device, wherein the clamping element is inserted in the blocking position. The contact area 44 of the clamping element 14 facing the housing body 12 has a groove-like recess 46 extending parallel with the guide strip 56. A support element 48, which protrudes from the housing body 12 and extends parallel with the recess 46, can extend into the recess 46 and be supported on the clamping element 14 when the door 10 is moved into the closed position, in accordance with the arrow D.

The support element 48, together with the groove-like recess 46, acts as a blocking means which secures the door. During movement of the door in the direction of the arrow D, the support element 48 snaps into the recess 46, because of which the door is automatically maintained in the open position.

The support element 48 forms the frame element of the housing body 12, on which the door hinges are attached, of which only the door hinge with the reference numeral 8 is shown in FIG. 6. The clamping element 14 is matched to the door hinge 8. The size and shape of the clamping element 14, or of the contact area 44 is determined, inter alia, by the opening angle of the hinge 8 and by the distance between the housing body 12 and the door 10.

Figure 7:
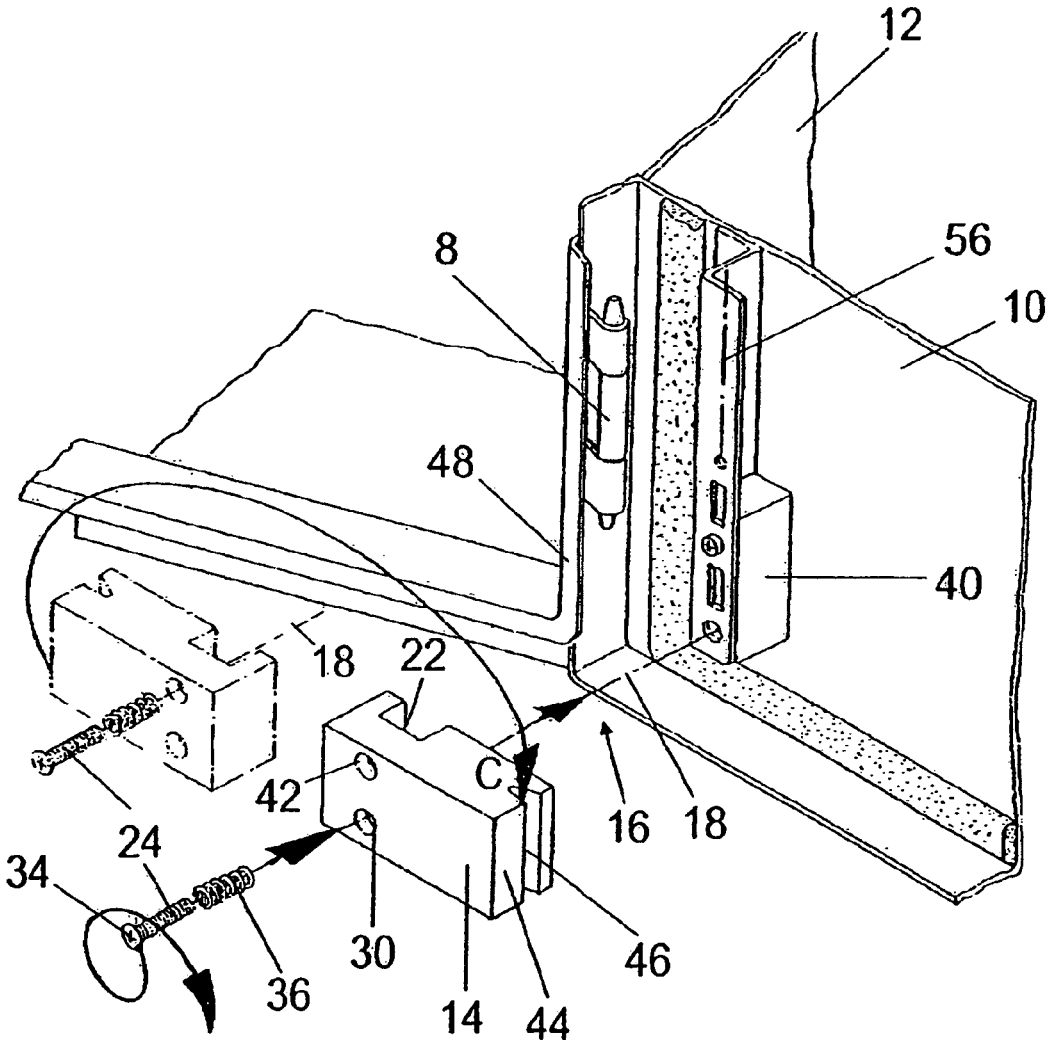
FIG. 7 shows the embodiment of the blocking device shown in FIG. 6, in a schematic perspective partial view and exploded representation, wherein a state is shown in which a clamping element is inserted in the neutral position and can be brought into the blocking position by pivoting.

In a schematic perspective partial view and in an exploded representation, FIG. 7 shows the embodiment of the blocking device shown in FIG. 6, wherein the clamping element 14 is inserted in the neutral position. In FIG. 7, this state is shown in solid lines and has been explained in view of FIG. 6.

It is furthermore shown in FIG. 7, by dash-dotted or thin lines to the left of the neutral position that the clamping element 14 can be pivoted into the blocking position, similar to the manner described by FIG. 5. The arrow C indicates the pivot direction from the blocking position to the neutral position.

Figure 8:
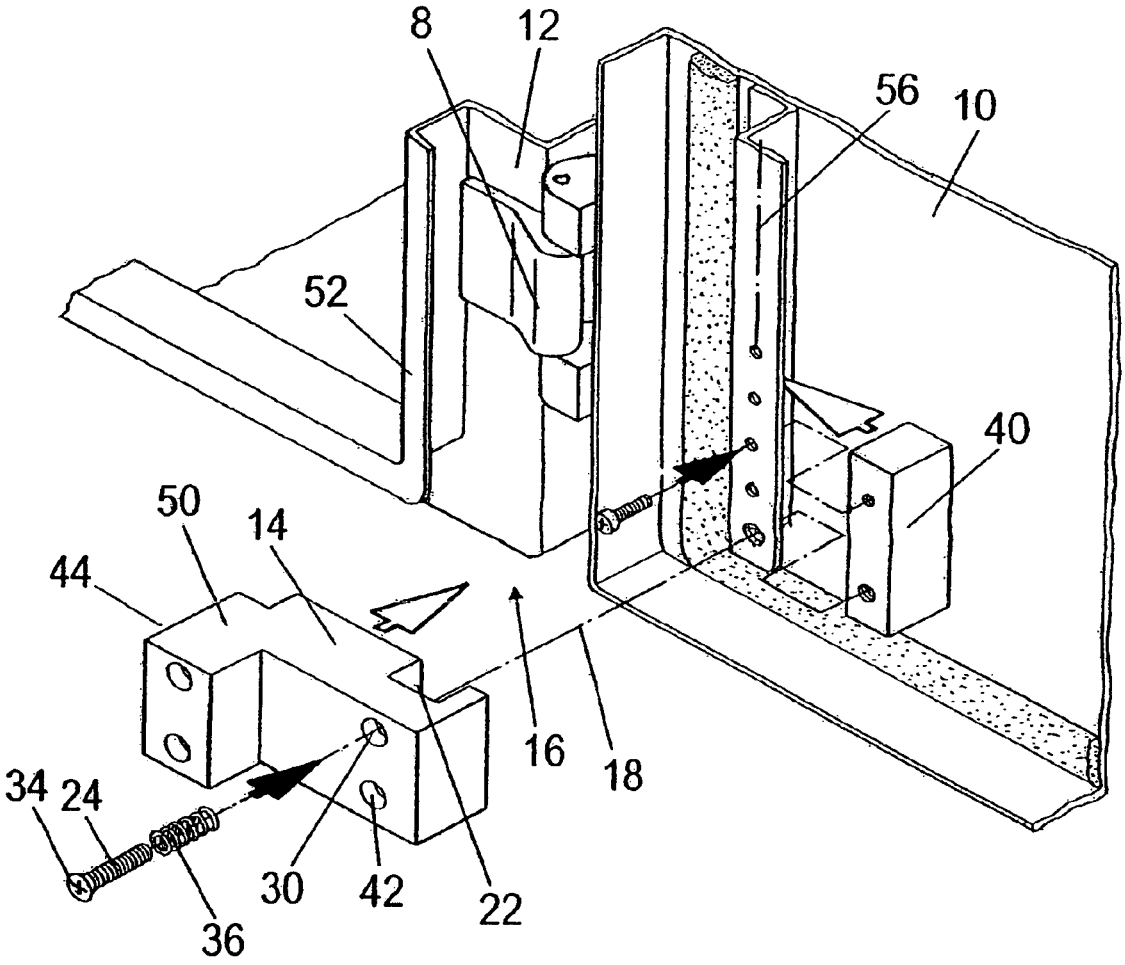
FIG. 8 shows another embodiment of the blocking device, in a schematic perspective partial view and an exploded representation, wherein a state is shown in which a clamping element having a step-shaped extension is inserted in the blocking position.

FIG. 8 shows a further embodiment of the blocking device, in a schematic perspective partial view and in an exploded representation, wherein a state in which the clamping element is inserted in the blocking position is shown. The contact area 44 of the clamping element 14 has a step-shaped extension 50. A support element 52 protrudes from the housing body 12. With the door 10 open, the support element 52 is supported on the step-shaped extension 50.

The support element 52 forms the frame element of the housing body 12, to which the door hinges are attached, of which only the door hinge with the reference numeral 8 is shown in FIG. 8. The design of the step-shaped extension 50 and of the support element 52 is matched to the door hinge 8. The size and shape is determined, inter alia, by the opening angle of the hinge 8 and by the distance between the housing body 12 and the door 10.

Figure 9:
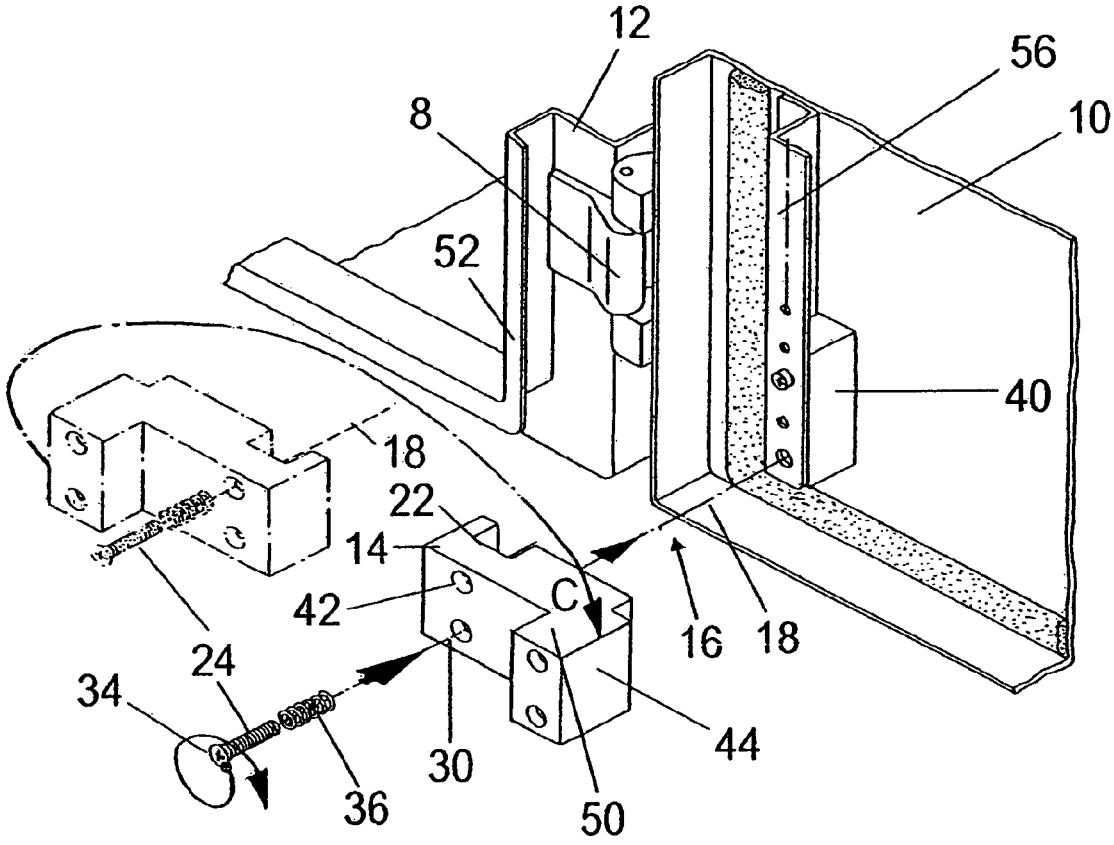
FIG. 9 shows the embodiment of the blocking device represented in FIG. 8 in a schematic perspective partial view and exploded representation, wherein a state is shown in which the clamping element is inserted in the neutral position and can be brought into the blocking position by pivoting.

In a schematic perspective partial view and in an exploded representation, FIG. 9 shows the embodiment of the blocking device shown in FIG. 8, wherein the clamping element is inserted in the neutral position. In FIG. 9, this state is shown in solid lines and has been explained in view of FIG. 8.

It is also shown in FIG. 9, by dash-dotted or thin lines to the left of the neutral position, that the clamping element 14 can be pivoted into the blocking position, similar to the way described in view of FIGS. 5 and 7. The arrow C indicates the pivot direction from the blocking position to the neutral position.

German Patent Reference 10 2005 050 639.9, the priority document corresponding to this invention, and its teachings are incorporated, by reference, into this specification.

What is claimed is:

1. A device for blocking open a door (10) of a housing, having a housing body (12) on which the door (10) is hinged, wherein a clamping element (14) is insertable into an area (16) between the housing body (12) and the door (10), the device comprising:

the clamping element (14) arranged on an inside of the door (10) rotatable about an axis of rotation (18) which extends perpendicularly with respect to the door (10) and is eccentrically seated on the clamping element (14), the clamping element (14) is rotatable into a blocking position in which the clamping element (14) projects beyond the door (10) when opened and is contactable with the housing body (l2); and a holding device connected with the clamping element (14), the holding device maintains the clamping element (14) in each of a blocking position and a neutral position, the holding device having a guide strip (20, 56) arranged on the door (10) which engages a recess (22) of the clamping element (14) when the clamping element (14) is in the blocking position to secure the holding device in the blocking position.

2. The device in accordance with claim 1, wherein in the neutral position the clamping element (14) is receivable inside the housing body (12) when the door (10) is closed.

3. The device in accordance with claim 2, wherein the blocking position is shifted by 180° with respect to the neutral position.

4. The device in accordance with claim 1, wherein the axis of rotation (18) is defined by a pin (24) having an end (26) fixed in place on the guide strip (20, 56), and the clamping element (14) has a first through-bore (30) arranged perpendicularly with respect to the recess (22) and eccentrically with respect to the axis of symmetry (28) of the clamping element, through which the pin (24) extends and which forms a rotatory seating for the clamping element (14).

5. The device in accordance with claim 4, wherein the pin (24) has a head (34) at a free end (32) located opposite the end (26) fixed on the guide strip (20, 56), and a compression spring (36) acts between the head (34) and the clamping element (14), which clamps the guide strip (20, 56) in place in the recess (22).

6. The device in accordance with claim 5, wherein the compression spring (36) is formed by a helical spring into which the pin (24) is introduced.

7. The device in accordance with claim 6, wherein a shoulder (38) is formed in the through-bore (30) on a side of the clamping element (14) facing the compression spring (36) on which the helical spring (36) is supported.

8. The device in accordance with claim 7, wherein the pin (24) is formed as a screw which engages a threaded element (40) of the guide strip (20, 56).

9. The device in accordance with claim 8, wherein the guide strip (20, 56) is formed by a perforated door strip.

10. The device in accordance with claim 9, wherein a second through-bore (42) arranged eccentric with respect to the axis of symmetry (28) of the clamping element (14) is cut in the clamping element and extends parallel with the first through-bore (30) and perpendicular to the recess (22).

11. The device in accordance with claim 10, wherein a blocking element acts between the clamping element (14) and the housing body (12), which maintains the door in the open position.

12. The device in accordance with claim 11, wherein the clamping element (14) has a contact area (44) on which the clamping element (14) can contact with the housing body (12) when the door (10) is open.

13. The device in accordance with claim 12, wherein the blocking element is formed at the contact area (44) of the clamping element (14).

14. The device in accordance with claim 13, wherein the contact area (44) of the clamping element (14) has a recess (46) into which when the door (10) is open a support element (48) on the housing body (12) extends and is supported against the clamping element (14).

15. The device in accordance with claim 14, wherein a snap-in holder is formed between the clamping element (14) and the housing body (12).

16. The device in accordance with claim 15, wherein the support element (48) forms the frame element of the housing to which at least one door hinge (8) is attached.

17. The device in accordance with claim 16, wherein at least one of the blocking element and the contact area (44) of the clamping element (14) are matched to the door hinge (8).

18. The device in accordance with claim 17, wherein the contact area (44) of the clamping element (14) has a step-shaped extension (50) against which a support element (52) protruding from the housing body (12) is supported when the door (10) is open.

19. The device in accordance with claim 1, wherein a blocking position is shifted by 180° with respect to the neutral position.

20. The device in accordance with claim 4, wherein the pin (24) is formed as a screw which engages a threaded element (40) of the guide strip (20, 56).

21. The device in accordance with claim 1, wherein the guide strip (20, 56) is formed by a perforated door strip.

22. The device in accordance with claim 4, wherein a second through-bore (42) arranged eccentric with respect to the axis of symmetry (28) of the clamping element (14) is cut in the clamping element and extends parallel with the first through-bore (30) and perpendicular to the recess (22).

23. The device in accordance with claim 1, wherein a blocking element acts between the clamping element (14) and the housing body (12), which maintains the door in an open position.

24. The device in accordance with claim 1, wherein the clamping element (14) has a contact area (44) on which the clamping element (14) can contact with the housing body (12) when the door (10) is open.

25. The device in accordance with claim 11, wherein the blocking element is formed at the contact area (44) of the clamping element (14).

26. The device in accordance with claim 11, wherein a contact area (44) of the clamping element (14) has a recess (46) into which when the door (10) is open a support element (48) on the housing body (12) extends and is supported against the clamping element (14).

27. The device in accordance with claim 11, wherein a snap-in holder is formed between the clamping element (14) and the housing body (12).

28. The device in accordance with claim 14, wherein the support element (48) forms the frame element of the housing to which at least one door hinge (8) is attached.

29. The device in accordance with claim 11, wherein at least one of the blocking element and the contact area (44) of the clamping element (14) are matched to the door hinge (8).

30. The device in accordance with claim 12, wherein the contact area (44) of the clamping element (14) has a step-shaped extension (50) against which a support element (52) protruding from the housing body (12) is supported when the door (10) is open.

31. A device for blocking open a door of a housing having a housing body on which the door is hinged, the device comprising:

a clamping element having a recess, the clamping element arranged on an inside of the door and rotatable about an axis of rotation which extends perpendicularly with respect to the door and through the recess and is eccentrically seated on the clamping element, the clamping element is rotatable into each of a blocking position and a neutral position, wherein in the blocking position the clamping element projects beyond the door when opened and is contactable with the housing body; and a holding device connected with the clamping element, wherein the holding device maintains the clamping element in each of the blocking position and the neutral position, the holding device including a guide strip arranged on the door that is engageable with the recess when the clamping element is in the blocking position to secure the clamping element in the blocking position, and that is engageable with the recess when the clamping element is in the neutral position to secure the clamping element in the neutral position.

32. The device in accordance with claim 30, further comprising:

a first through-bore in the clamping element, the first through-bore arranged about the axis of rotation and perpendicularly with respect to the recess;

a pin extending through the first through-bore, the pin having an end fixed in place on the guide strip and a head formed at an opposing free end; and a compression spring formed by a helical spring positioned around the pin between the head and the clamping element, wherein the clamping element is liftable in a direction against a spring force of the compression spring to bring the recess out of contact with the guide strip to allow shifting of the clamping element around the axis of rotation between the blocking position and the neutral position.

33. The device in accordance with claim 31, wherein the blocking position is shifted by 180° with respect to the neutral position.

* * * * *